United States Patent [19]

Ennes et al.

[11] 4,042,028

[45] Aug. 16, 1977

[54] ADJUSTABLE TUBE SHADE ROLLER

[76] Inventors: John W. Ennes, 26738 Columbia St.; John P. Ennes, 26374 Liberty Drive, both of Hemet, Calif. 92343

[21] Appl. No.: 636,109

[22] Filed: Nov. 28, 1975

[51] Int. Cl.[2] ..... A47G 5/02

[52] U.S. Cl. ..... 160/263; 160/310; 160/313; 160/319

[58] Field of Search ..... 160/263, 238, 313, 323 R, 160/325, 324, 326, 250, 310, 319

[56] References Cited

U.S. PATENT DOCUMENTS

| | | | |
|---|---|---|---|
| 7,098 | 2/1850 | Clark | 160/263 |
| 1,732,430 | 10/1929 | Bender et al. | 160/263 |
| 1,920,099 | 7/1933 | Moricca | 160/325 X |
| 2,307,095 | 1/1943 | Zaferakis | 160/263 |
| 2,530,462 | 11/1950 | Gwin | 160/313 |
| 3,308,874 | 3/1967 | Anderson | 160/326 |
| 3,580,323 | 5/1971 | Gossling et al. | 160/263 |
| 3,722,573 | 3/1973 | Stark | 160/323 R |

*Primary Examiner*—Philip C. Kannan

[57] ABSTRACT

A shade roller, comprised of a tube into which the motor drive is inserted into one end leaving it fully adjustable in length as it is slid in or out of the tube (Main Body), using any means of screw adjustment, shims etc. One end of the motor has a standard tip to fit into a standard shade mounting bracket, the other end is made to lock into a mounted drive block which is mounted within the main body of the roller. The locking of the motor with the drive block, can be accomplished with any means of connection that will result in the motor being unable to turn within the main body of the shade roller and at the same time leave the motor free to be adjusted in or out for the length adjustment. At the other end, a sliding shaft is inserted in much the same manner as the motor. It is fully adjustable for length as is the motor end, and is fully adjustable by similar means of shims, screw adjustments etc. as is the motor end. This shaft is not necessary to be locked into a lock block as it may turn or spin within the main body as it will. At the end of this shaft is a standard roller pin that will fit into a standard shade mounting bracket. The length adjustments, and motor replacement is designed to be accomplished fully independent and without disturbing the shade materials, and to be accomplished with the use of simple everyday tools such as screw driver or in the case of the use of shims, no tools will be required. The main body of the roller is perfectly smooth, with no bumps, ridges, grooves or indents that are damaging to the materials on the roller.

11 Claims, 9 Drawing Figures

ADJUSTABLE TUBE SHADE ROLLER

FIELD OF THE INVENTION

This invention relates to window shade rollers, and more specifically a shade roller with adjustable shafts at each end making it fully adjustable in length, and having a replacable motor, that requires no tools or special talents or training to replace. All replacements or adjustments can be made completely independent of the materials on the main body of the roller. In the case of extreme length adjustments, the main body with the materials on the body and the shaft with the pin inserted in the body, can be cut for length utilizing a standard high speed power chop saw with a fine tooth blade. (A chop saw of the type Rockwell International Manufactures is ideal) Cutting the roller and materials in this manner greatly reduces labor costs and simplifies work that prior to this invention, had to be accomplished at great labor cost with big cutting tables, by people with great skills in the art of making shades. The roller is also easily convertable to a cord and reel type operation or any other motor type desirable.

DESCRIPTION OF THE PRIOR ART

Shade rollers are common to the industry and have been used for many many years. All previously known rollers however are only adjustable in length before the materials are installed on the roller, and are only adjustable at one end. None of the previously known art had replaceable motors. If the motor failed the shade had to be taken down, returned to a shade shop that was properly equipped to remove the roller and re-install a completely new roller at great cost to the consumer.

The shade installer, when arriving on the job to install the roller of prior art, would find in the case of a mismeasure, that he would have to return to the shop and the adjustment in length had to be made within the shop by skilled personnel, using special tables, special tools and special training. If the installer had had the invention that is the subject of this application, he could have made the adjustments and completed the installation, thereby saving himself an additional trip to the job. All of the prior art has either bumps, ridges, grooves or indents or are made in sections that result in bumps, ridges, grooves or indents that are very damaging to delicate shade fabrics such as transparent shade materials. The methods of installing the materials on the prior art tend to leave materials hanging unevenly, or in the case of staples or nails, they are damaging to delicate shade materials such as the transparent shade materials. None of the prior art, with the exception of the wooden and cardboard and other rollers of materials similar could be cut for length after the materials are installed on the roller. Though these types can be cut on a special shade cutter, after they are cut to length, there are no other proper length adjustments that can be made. If a mistake is made, there is no room for error and a new shade must be cut.

SUMMARY OF THE INVENTION

In its basic concept, the present invention provides an advanced window shade roller for the industry that can be adjusted for length at both ends by simple means either before or after the materials have been installed. It provides for the consumer, a shade roller with a replaceable motor, that can be replaced by him with minimum cost within his own home. It provides a roller that can be converted to use with any type motor or drive unit desired, by the mere removal of one type of motor and the insertion of another type in its place. This invention, by its design, also provides a perfectly smooth body with no bumps, ridges, grooves or indents to damage any type of shade fabric that may be used on it.

DESCRIPTION OF THE PREFERRED EMBODIMENT

Figure 1:
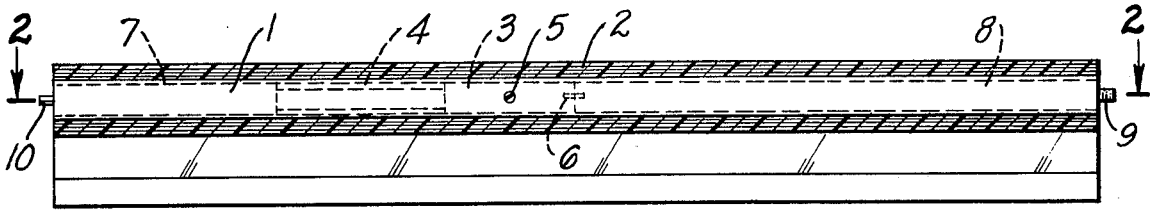
FIG. 1 is a side elevation partially in section of a window shade of the preferred embodiment ready for installation.
Figure 2:
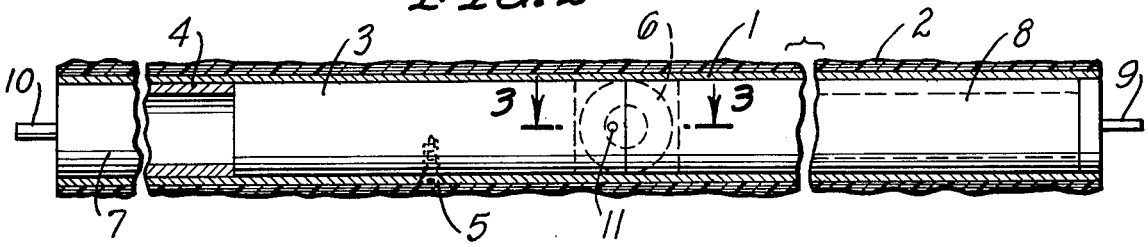
FIG. 2 is a longitudinal cross section, with certain parts shown in elevation, at an enlarged scale taken on the line 2—2 of FIG. 1.
Figure 3:
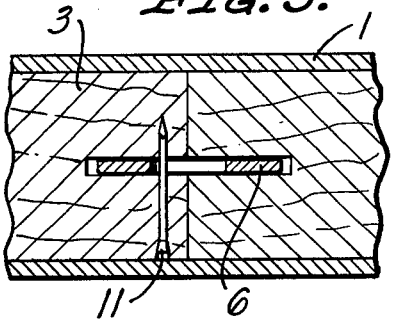
FIG. 3 is a fragmentary cross section at an enlarged scale showing the driving connection, taken on line 3—3 of FIG. 2.
Figure 4:
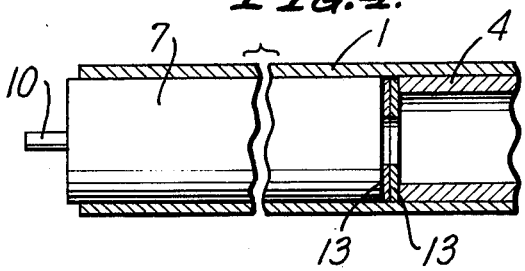
FIG. 4 is a fragmentary cross section showing the use of common washers as shims for precise adjustment of length.
Figure 5:
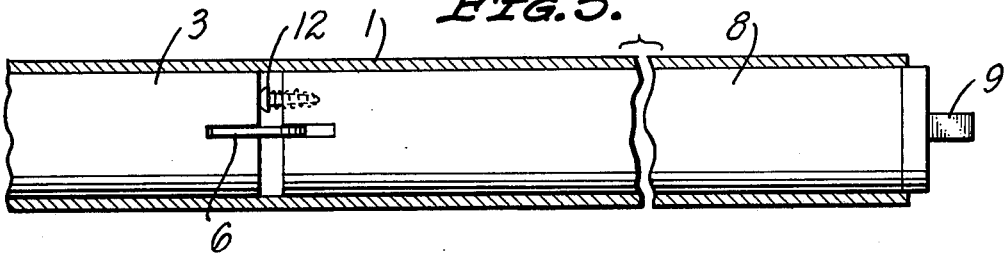
FIG. 5 is a fragmentary cross section showing the use of common screws as the means of making precise length adjustments.
Figure 6:
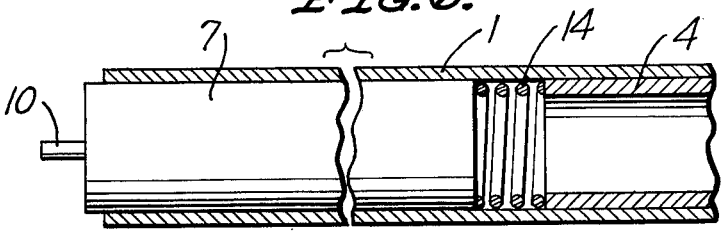
FIG. 6 is a fragmentary cross section showing the use of a spring to exert a constant pressure on the shaft, thereby allowing for length adjustments without any further parts, tools or adjustments in the shop.

In the description of the preferred embodiment, the various components of the preferred embodiment are designated by reference numerals as indicated below:

1. Main body of shade roller
2. Shade materials
3. Drive Block or insert
4. Tube Filler or insert
5. Lock block screw
6. Lock block washer
7. Tip Shaft
8. Motor shaft
9. Motor tip
10. End tip
11. Washer locking nail.
12. Length adjustment screw.
13. Length adjustment shims
14. Length adjustment spring
15. Cord and reel adapter
16. Electric or other type motor adapter
17. High speed — fine tooth saw blade
18. Cord and reel operating cord In FIG. 1. there is shown a drawing to reduced scale of an embodiment of the invention in its completed form, with the shade materials on the main body. The roller, by its design can use any standard or otherwise motor 8 and at the same time, the motor shaft is adjustable in length within the main body 1 of the roller, using any adjustable length means such as screw adjustments 12, shims 13, springs 17 etc. One end of the motor would have a tip 9 that would fit into any standard shade mounting bracket, and the other end would be made to lock into a drive block 3 mounted permanently into the main body 1 in such a manner that would prevent the motor shaft 8 from turning within the main body 1 and at the same time leave the motor shaft 8 fully adjustable in length. The drawings show one form of such connection with a common washer 6 as the locking part of the drive block 3. The other end of the roller is comprised of a sliding shaft 7 that is mounted in much the same manner as the motor shaft 8, and is fully adjustable by similar means of screw adjustments 12 shims 13, springs 17 etc. as is the motor end. The tip shaft 7 is not necessary to be locked into a drive block 3 as it may turn or spin within the main body as it will. At the end of this shaft 7 is a standard roller pin 10 that will fit into a standard shade mounting bracket. The length adjustments and motor replacements are designed to be accomplished fully independent and without disturbing the shade materials. The main body (1) is in the form of a tube in which an inexpensive tube filler 4 constructed of a material such as cardboard can be placed. The tube filler 4 prevents the tip shaft 7 from sliding fully inside the main body 1 of the roller. This tube filler 4 can be of any length depending upon the length desired in the tip shaft 7. The main body 1 is made of a continuous tube, thus eliminating any flaws in the surface.

Figure 7:
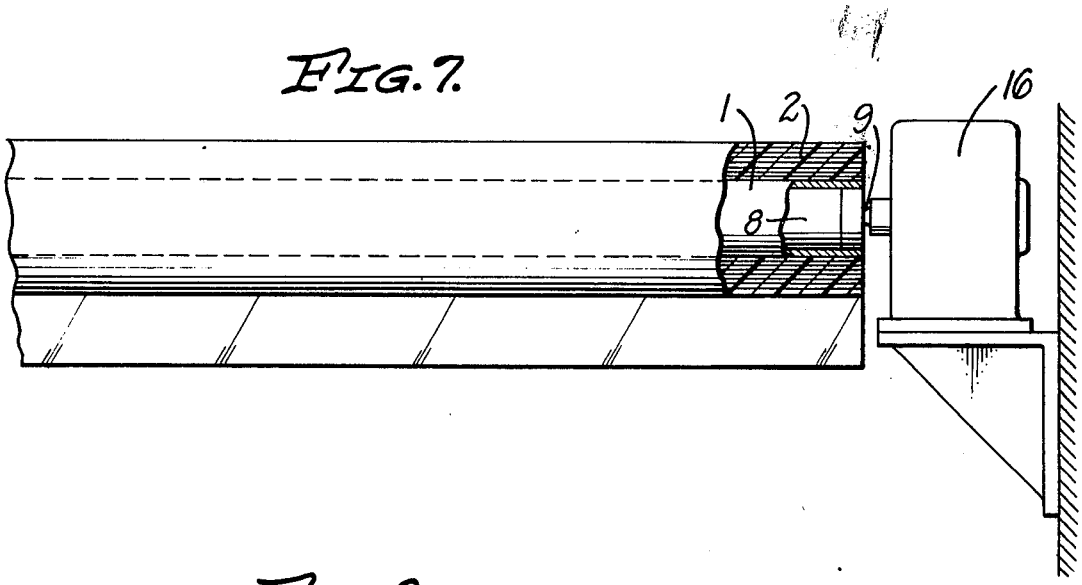
FIG. 7 is an elevational view partially in section of a window shade utilizing an electric or other type external mounted motor for shade operation.
Figure 8:
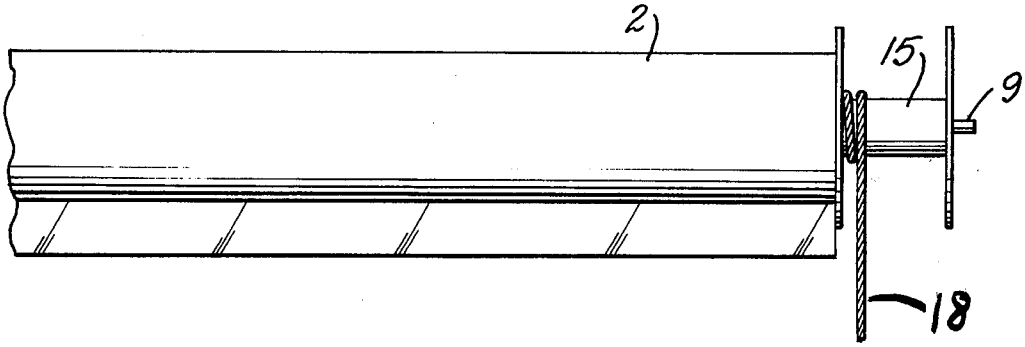
FIG. 8 is an elevational view of a window shade utilizing a standard cord and reel adapter for manual shade operation.

By its design, the motor shaft 8 can be easily converted to any type of motor or manual operation that is desired. Two typical types are shown in figures 7 and 8 of the drawings.

Figure 9:
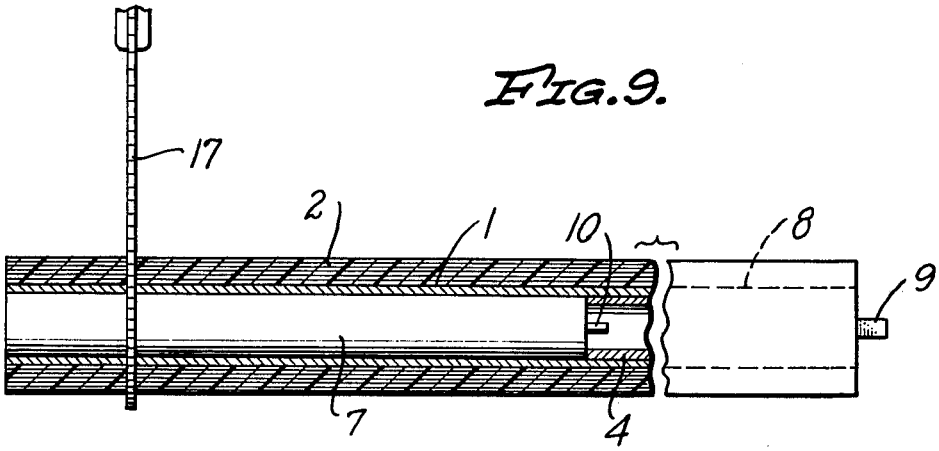
FIG. 9 is an elevational view partially in section of a window shade during the cutting operation, showing manner in which tip end of roller shaft is reversed into the main body of roller and the entire shade with the materials installed can be cut with a standard chop saw (High speed w/fine tooth blade) to provide the proper length.

This roller, by its design, can be cut with a high speed power saw common to the industry either before or after the shade materials 2 have been installed on the main body of the roller. Referring to figure 9 of the drawings, the main body 1 of the roller with the materials 2 installed on the roller and the tip shaft 7 inserted in the end of the main body 1 with the end tip 10 to the inside of the main body 1 and within a recess of the tube filler or insert 4, the completed product can then be cut with an ordinary high speed saw blade 17. After the cutting operation, the tip shaft 7 is then pulled out and reinserted into the main body 1 with the end tip 10 to the outside and the operation is completed.

Having described our invention, we claim:

1. A window shade roller comprising:

a main body including a tube, the opposite ends of said tube being open, said tube being adapted to have a window shade wound thereon;

a first shaft receivable in said one end of said tube, said first shaft including a motor tip exposed adjacent said one end of said tube;

means for drivingly coupling the first shaft to the tube so that the first shaft and the tube can rotate together;

a second shaft including a shaft tip, said second shaft being received within the other end of said tube with the shaft tip exposed at said other end of said tube;

adjustable means for limiting the innermost axial position of one of the shaft within the tube whereby the length of the window shade roller can be adjusted;

means for limiting the amount the other of the shafts can be inserted into the tube; and said adjustable means including an insert mounted within said tube and adjustable length means cooperating with the insert to positively limit the innermost axial position of said one shaft within the tube.

2. A window shade roller as defined in claim 1 wherein said adjustable length means includes a screw mounted on one of said one shaft and said insert.

3. A window shade roller as defined in claim 1 wherein said adjustable means includes at least one shim positioned between said insert and said one shaft.

4. A window shade roller as defined in claim 1 wherein said limiting means includes adjustable means for limiting the innermost axial position of the other of said shafts within the tube.

5. A window shade roller comprising:

a main body including a tube, the opposite ends of said tube being open, said tube being adapted to have a window shade wound thereon;

a first shaft receivable in one end of said tube, said first shaft including a motor tip exposed adjacent said one end of said tube;

means for limiting the amount the first shaft can be inserted into the tube;

means for drivingly coupling the first shaft to the tube so that the first shaft and the tube can rotate together;

a second shaft including a shaft tip, said second shaft being received within the other end of said tube with the shaft tip exposed adjacent said other end of said tube; and an insert within said tube for limiting the amount the second shaft can be inserted into the tube, said insert having a recess therein of sufficient size to accommodate the shaft tip.

6. A window shade roller comprising:

a main body including a tube, the opposite ends of said tube being open, said tube being adapted to have a window shade wound thereon;

a motor receivable in one end of said tube, said motor including a motor tip exposed adjacent said one end of said tube;

first means for drivingly coupling the motor to the tube without preventing withdrawal of the motor from the tube by pulling axially outwardly on the motor whereby the motor can be easily withdrawn from said tube by pulling the motor out of the tube;

a shaft including a shaft tip, said shaft being received within the other end of said tube with the shaft tip exposed adjacent said other end of said tube;

means for limiting the amount the shaft can be inserted into the tube;

means for limiting the amount the motor can be inserted into the tube; and said first means including a drive block within said tube and affixed to the tube so as to prevent relative rotation therebetween and cooperating means on said motor and said drive block for drivingly coupling the motor to the drive block for rotation together.

7. A window shade roller as defined in claim 6 wherein said cooperating means includes a projection on one of said motor and said drive block and a cooperating recess on the other of said motor and said drive block, said recess being adapted to receive said projection to couple the motor to the drive block for rotation together.

8. A window shade roller comprising:

a main body including a tube, the opposite ends of said tube being open, said tube being adapted to have a window shade wound thereon;

a motor receivable in one end of said tube, said motor including a motor tip exposed adjacent said one end of said tube;

first means for drivingly coupling the motor to the tube without preventing withdrawal of the motor from the tube by pulling axially outwardly on the motor whereby the motor can be easily withdrawn from said tube by pulling the motor out of the tube;

a shaft including a shaft tip, said shaft being received within the other end of said tube with the shaft tip exposed adjacent said other end of said tube;

means for limiting the amount the shaft can be inserted into the tube;

means for limiting the amount the motor can be inserted into the tube; and said limiting means for said shaft including an insert within said tube, said insert having a recess of sufficient size to fully receive said shaft tip.

9. A window shade roller as defined in claim 8 wherein said first means includes a drive block within said tube and affixed to the tube so as to prevent relative rotation therebetween and cooperating means on said motor and said drive block for drivingly coupling the motor to the drive block for rotation together, said cooperating means includes a projection on one of said motor and said drive block and a cooperating recess on the other of said motor and said drive block, said recess being adapted to receive said projection to thereby couple the motor and the drive block for rotation together, and at least one of said limiting means is adjustable whereby the length of the window shade roller can be adjusted.

10. A window shade roller comprising:

a main body including a tube, the opposite ends of said tube being open, said tube being adapted to have a window shade would thereon;

a motor receivable in one end of said tube, said motor including a motor tip exposed adjacent said one end of said tube;

first means for drivingly coupling the motor to the tube without preventing withdrawal of the motor from the tube by pulling axially outwardly on the motor whereby the motor can be easily withdrawn from said tube by pulling the motor out of the tube;

a shaft including a shaft tip, said shaft being received within the other end of said tube with the shaft tip exposed adjacent said other end of said tube;

means for limiting the amount the shaft can be inserted into the tube;

means for limiting the amount the motor can be inserted into the tube; and at least one of said limiting means being adjustable whereby the length of the window shade roller can be adjusted, said adjustable limiting means including an insert within said tube and fixed axially relative to said tube and adjustable length means cooperating with the insert to positively limit the amount the one of said motor and said shaft which is associated with the adjustable limiting means can be inserted into said tube.

11. A method of making a window shade roller of the desired length comprising:

providing an open-ended tube, an insert in the tube, a recess in the tube opening toward one end of the tube, and a shaft tip at one end of the shaft with said one end of the shaft being inserted into one end of the tube, the shaft tip being received in said recess, and the amount the shaft can be inserted into the tube being limited by the insert;

cutting the tube and the shaft to the desired length while the shaft is inserted into the tube with the shaft tip in said recess;

withdrawing the cut shaft from the cut tube; and inserting the other end of the cut shaft into the cut tube with the insert limiting the amount that the shaft can be inserted into the tube.

* * * * *